United States Patent [19]

Palazzo

[11] Patent Number: 4,780,946

[45] Date of Patent: Nov. 1, 1988

[54] METHOD OF MAKING DOUBLE WALL STORAGE TANK WITH BEADED SPACER MEANS

[76] Inventor: David T. Palazzo, P.O. Box 290676, Tampa, Fla. 33687

[21] Appl. No.: 105,881

[22] Filed: Oct. 7, 1987

Related U.S. Application Data

[60] Continuation-in-part of Ser. No. 43,634, Apr. 28, 1987, Pat. No. 4,744,137, which is a division of Ser. No. 884,481, Jul. 11, 1986, abandoned, which is a continuation-in-part of Ser. No. 775,140, Sep. 12, 1985, Pat. No. 4,640,439, which is a continuation-in-part of Ser. No. 818,258, Jan. 13, 1986, Pat. No. 4,644,627.

[51] Int. Cl.[4] ..... B23P 9/00

[52] U.S. Cl. ..... 29/455.1; 29/458; 138/149; 215/12.2; 220/445; 264/251

[58] Field of Search ..... 29/455 R, 458, 447; 215/12.2; 138/148, 149; 264/251, 318; 220/448, 466, 469, 465, 226, 855, 449, 445, 420, 1 B

[56] References Cited

U.S. PATENT DOCUMENTS

| | | | |
|---|---|---|---|
| 761,548 | 3/1904 | Sheaff | 220/445 |
| 2,551,710 | 5/1951 | Slaughter | 29/455 R |
| 3,746,595 | 7/1973 | Leasor | 264/251 X |
| 3,848,765 | 11/1974 | Durkop | 220/445 |
| 3,921,273 | 11/1975 | Kondo et al. | 29/455 R X |
| 3,987,925 | 10/1976 | Sattelberg | 220/445 X |
| 4,523,454 | 6/1985 | Sharp | 220/449 |
| 4,524,609 | 6/1985 | Sharp | 73/49.2 |
| 4,537,328 | 8/1985 | Keesee et al. | 220/445 |
| 4,651,893 | 3/1987 | Mooney | 220/445 |

FOREIGN PATENT DOCUMENTS

| | | | |
|---|---|---|---|
| 197808 | 8/1978 | Switzerland | 220/445 |

*Primary Examiner*—Charlie T. Moon

*Attorney, Agent, or Firm*—Pettis & McDonald

[57] ABSTRACT

A double wall tank for the storage of liquids is manufactured from a rigid single wall inner tank by applying to at least a portion of the exterior surface of the inner tank a plurality of spaced apart, generally parallel beads of a hardenable, viscous liquid synthetic resin spacer material to form, between adjacent beads, one or more channels that provide for substantially free passage of liquids through the channels. A substantially imperforate film is stretched across the beads and over the one or more channels to separate the inner tank and the beads from subsequently applied sheathing material. A substantially rigid outer sheathing material that is substantially liquid-tight is applied over the inner tank exterior and the beads and the film overlying the beads such that the sheath is spaced from at least a portion of the inner tank exterior surface so as to provide a rigid double wall tank.

10 Claims, 1 Drawing Sheet

METHOD OF MAKING DOUBLE WALL STORAGE TANK WITH BEADED SPACER MEANS

RELATED APPLICATION

This application is a continuation-in-part of application Ser. No. 043,634 filed Apr. 28, 1987, now U.S. Pat. No. 4,744,137, which application is a division of application Ser. No. 884,481, filed July 11, 1986, now abandoned, which application is a continuation-in-part of application Ser. No. 775,140 filed Sept. 12, 1985, and issued as U.S. Pat. No. 4,640,439 and a continuation-in-part of application Ser. No. 818,258 filed Jan. 13, 1986, and issued as U.S. Pat. No. 4,644,627, both entitled Double Wall Storage Tank and Method of Making Same and filed in the name of David T. Palazzo.

FIELD OF THE INVENTION

This invention relates to a double wall tank for the storage, and in particular for the underground storage, of liquids and to an improved method for making such a double wall storage tank.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has promoted the search for methods of fabricating relatively inexpensive double wall tanks. This burden has also given impetus to the search for a method of remanufacturing existing single wall tanks into a double wall assembly with means for detecting the presence of any leaks into the space between the two walls.

A number of techniques have been disclosed for converting single wall tank into double wall tank and providing such tanks with the means for detecting the presence of leaks. Such methods are shown for example in my U.S. Pat. Nos. 4,640,439 and 4,644,627 as well as my copending application Ser. No. 043,634. Although these techniques provide for quite acceptable double wall tanks they do require the employment of a perforated spacing material such as mesh, or alternatively, a molded spacing material that must be constructed and applied to the inner tank. The labor and time involved in constructing and installing these spacing materials can be significant and the need exists to reduce even further the cost of producing such double wall tanks.

SUMMARY OF THE INVENTION

In view of the foregoing it is the object of the present invention to provide an improved economical method of manufacturing a double wall storage tank from a single wall tank.

It is a further object of this invention to provide such a method in which at least a portion of the outer wall or sheath of the tank is spaced from the inner tank.

It is a further object of this invention to provide a method of constructing a double wall storage tank that does not require the construction or installation of intricate or expensive spacing materials and instead employs efficient and relatively inexpensive spacer construction techniques.

To achieve these and other objects that will become readily apparent to those skilled in the art, this invention provides a method of manufacturing from a rigid single wall inner tank a double wall tank for the storage of liquids. This method includes the steps of applying to at least a portion of the exterior surface of the rigid inner tank a plurality of spaced apart, generally parallel beads of a hardenable viscous liquid synthetic resin spacer material to form, between adjacent beads, channel means that provide for substantially free passage of liquids through the channel means. A substantially imperforate film is stretched over the beads and over the channel means to separate the inner tank and the beads from subsequently applied sheath material. A substantially rigid outer sheath of material that is substantially liquid-tight is applied over the inner tank exterior and the beads and the film overlying the spacer material. The sheath is spaced from at least a portion of the inner tank exterior surface by the film and the beads such that a rigid double wall tank is provided.

In a preferred embodiment the synthetic resin spacer material may include a thermoplastic substance, such as polyethelene or similar material that hardens by cooling or, alternatively, may include a substance that hardens by catalyzing. The synthetic resin beads may be applied in gelatinous form and may comprise an epoxy or various other synthetic resins. The spacer material may be applied in the form of a self expanding foaming agent. A polyester foam or similar substance is especially preferred, and foamed silica may be employed so that excessive fluidity of the resin is prevented. Foam permits a desirable thickness of spacer material to be achieved while reducing the amount of such material required. The imperforate film may include a synthetic resin such as Mylar, polyethylene or other similarly thin material.

Preferably the beads of resin are applied by disposing a resin dispensing apparatus adjacent the inner tank and discharging resin through discharge ports in the dispensing apparatus while moving the inner tank and the dispensing apparatus relative to one another. In this manner resin is dispensed on the exterior surface of the tank. The resin dispensing apparatus may include a housing for containing the resin and in which the discharge ports are disposed. Apparatus for urging the resin out through the discharge ports may also be provided. Such apparatus may include a pressurized resin source or alternative means.

Preferably, the inner tank has a generally cylindrical configuration with closed ends and the beads and channels are formed substantially circumferentially about the inner tank. A plurality of circumferential rows of radially outwardly facing beads may be applied to such a cylindrical inner tank and the channels may be formed substantially circumferentially about the inner tank between the rows of beads.

The method of this invention may further comprise the step of forming passageways that interconnect adjacent channels. Such passageways are typically formed either by interrupting the discharge of resin or by scoring the resin beads between adjacent channels. Passageways may be formed proximate the bottom of the cylindrical inner tank as well as at other locations about the circumference of the inner tank.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENT

Figure 1:
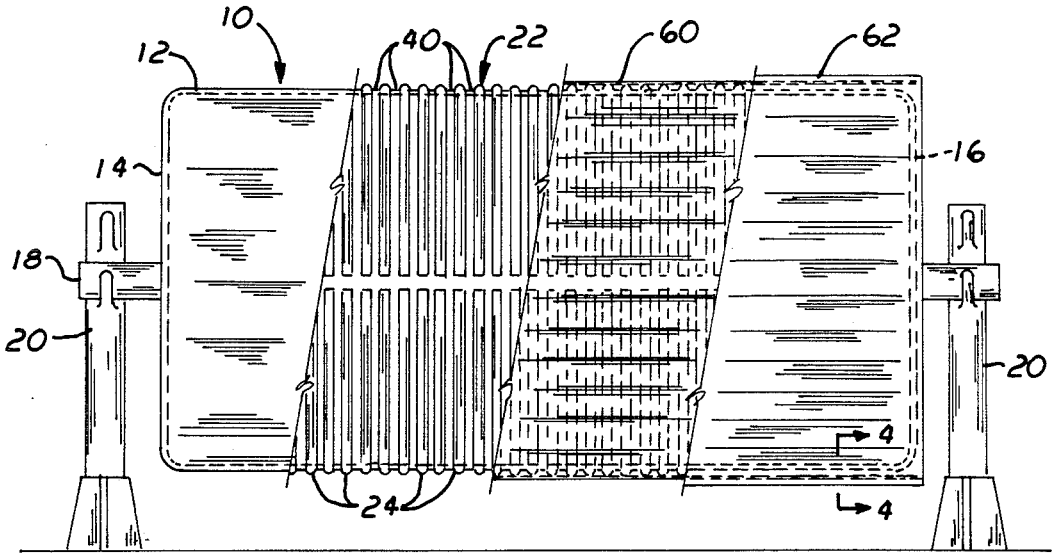
FIG. 1 is a side elevational view, partially in section, of a tank according to the present invention illustrating various steps in the fabrication process.

A preferred embodiment of the double wall tank 10 manufactured according to the method of this invention is illustrated in FIG. 1. The completed tank assembly is accomplished by applying the various materials, as hereinafter described, to an inner storage tank 12.

While various forms and shapes of tanks may be utilized in practicing this invention, the most common shape for underground storage is that of a cylinder, generally a right circular cylinder, having closed end portions 14 and 16. For simplicity of illustration this configuration of the tank is utilized for illustrating the preferred embodiment of the invention. Also, while virtually any construction of a rigid inner tank, whether metal or fiberglass or other materials, may be utilized in practicing this invention, one preferred and readily available type of structure is a tank formed of welded steel, having an appropriate corrosion resistant coating on the liquid contact surfaces. For purposes of illustration such a sealed tank will be described. It also is to be understood that the tank to be used could be a newly fabricated tank, which may or may not have any manhole opening cut in it, or it may be a previously used tank removed from its prior underground installation and cleaned for reuse with this invention.

To prepare an uncoated or previously used steel tank, it is desirable that the exterior surface be conventionally sandblasted and coated with a rust inhibitive paint. Then, to simplify subsequent steps, it is preferred but not required that a spindle 18 be attached, such as by welding, to the center of each tank head or end portion 14, 16 collinear with the axis of tank 12. As shown in FIG. 1, these spindles 18 and thus the inner tank 12 may then be supported off the ground on conventional uprights 20. This provides for rotation of the tank about its axis for purposes to be set forth below.

Figure 2:
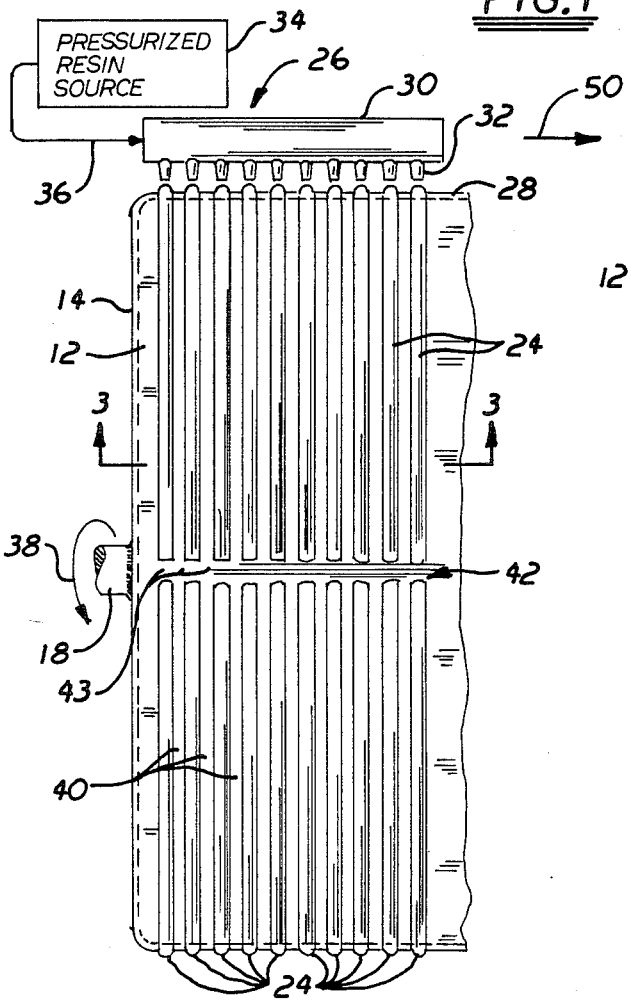
FIG. 2 is a fragmentary side elevational view of a rotatably mounted inner tank and a preferred means for applying to the exterior surface of the tank substantially parallel beads of a synthetic resin spacer material.

In the next step of the present invention beads 24 of a spacer material 22 are applied to at least a portion, preferably at least the lower portion, of the exterior surface of inner tank 12 and may be applied, as shown in FIGS. 1 and 2, to generally the entire exterior side surface 28 of tank 12. Spacer material 22 includes a plurality of spaced apart substantially parallel circumferential beads 24 that may comprise any of a variety of types of hardenable, viscous liquid synthetic resin. As used herein, hardenable viscous liquid refers to any substance applied in a softened yet workable state and hardened by a thermal or catalyzing process. In one preferred embodiment, the resin may be applied in the form of a thermoplastic such as polyethelene or similar material that has been heated into a viscous liquid state. Alternatively, the resin may be applied in the form of a known polyester resin having a self expanding foaming agent. A desired foamable resin material having a normal thickness of, for example, 0.020 inches expands to approximately 0.040 inches. Where foam is employed, less resin material is required to provide the required thickness of beads 24 of spacer material 22. In a further preferred embodiment, beads 24 may be applied in gelatinous form and may be formed of epoxy or a similar substance that hardens by catalyzing.

A preferred technique for applying spacer material beads 24 is shown in FIG. 2. A resin dispensing apparatus 26 is disposed adjacent the exterior side surface 28 of inner tank 12 proximate one end, e.g. end 14, of the inner tank. Apparatus 26 comprises a housing 30 having a plurality of discharge ports 32 that are preferably aligned. Although discharge ports 32 are disclosed as nozzles, in alternative embodiments the discharge ports may be formed by providing simple openings in the wall of housing 30. A conventional pressurized resin source 34 is attached by a supply line 36 to the interior of housing 30. If beads 24 are applied as a thermoplastic, the resin is heated either in resin source 34 or by alternative, conventional thermoplastic heating means, not shown, that are connected to housing 30 and operate in a conventional manner.

To apply resin spacer material beads 24 to inner tank 12, pressurized resin source 34 is operated to introduce resin into housing 30. This resin is urged out through ports 32 and, at the same time, inner tank 12 is rotated in the direction of arrow 38 about spindle 18 upon supports 20 shown in FIG. 1. This causes parallel resin spacer material beads 24 to be formed circumferentially about inner tank 12. The resin beads are then permitted to harden. A thermoplastic substance such as polyethelene typically hardens as it cools whereas a substance such as foam or epoxy typically catalyzes to form the hardened spacer beads.

Figure 3:
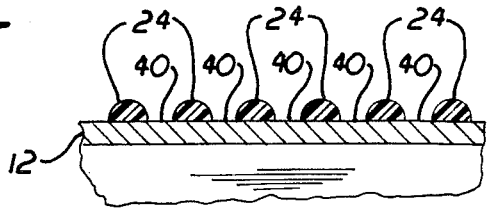
FIG. 3 is an enlarged sectional view of the spacer material disposed on the inner tank to form circumferential channels between the beads.

As shown in the enlarged fragmentary view of FIG. 3 resin spacer material beads 24 may have a somewhat rounded cross-sectional shape. Because the discharge ports 32 are generally equally spaced along housing 30 the resulting beads 24 have generally equal spaces between them. These spaces between pairs of adjacent beads 24 form channel means 40 that provide for substantially free passage of liquids longitudinally therethrough. A plurality of channels 40 are formed circumferentially about the exterior side surface 28 of inner tank 12. More particularly, as best shown in FIG. 3, the side walls of each channel 40 are formed by adjacent beads 24, and the bottom of channel 40 is formed by the exterior surface of inner tank 12. In an alternative embodiment, the spacing between beads 24 may be nonuniform and, in any event, the precise spacing between the beads is not a limitation of this invention. Preferably the channels 40 should not be so wide that the imperforate film, described below, will sag into the channels sufficiently to block the flow therethrough of the fluid that ultimately is to be stored in the tank.

As inner tank 12 is rotated, it may be desirable to provide one or more transverse passageways 42 through beads 24 between adjacent channels at various locations around the tank. One such transverse passageway 42 is shown in FIGS. 1 and 2, and an additional transverse passageway 42, located in the bottom of the completed tank structure is shown in the sectional view of FIG. 4. Additional passageways may be formed transversely through beads 24 at other points about the circumference of the tank, for example, at locations about tank 12 spaced 180° from the passageways 42 shown in FIGS. 1, 2 and 4. The passageways function as described more fully below.

Passageways 42 may be formed by momentarily interrupting the discharge of synthetic resin from apparatus 26 while inner tank 12 continues to rotate. For example, as shown in FIG. 2, inner tank 12 may be rotated in the direction of arrow 38 while resin is discharged by apparatus 26, so that a first set of substantially parallel resin beads 24 is formed on the lower portion of tank 12. The flow of pressurized resin is then stopped momentarily while inner tank 12 continues to rotate in the direction of 38 so that a gap 43 is formed in each resin bead 24. These gaps 43, together with the portions of adjacent channels between them, form the passageway 42. After the gaps 43 are formed, the inner tank 12 continues to rotate, and discharge of resin spacer material from apparatus 26 is resumed so that a second set of beads 24 are formed on the upper portion of inner tank 12. In an alternative embodiment, passageways 42 may be formed by scoring or cutting the resin beads 24 either in its prehardened or hardened form.

After inner tank 12 has been completely axially rotated, beads 24, alternating channels 40, and interconnecting passageways 42 are formed in a circumferential portion of inner tank 12, for example as shown in FIG. 2 the circumferential portion proximate end portion 14 of tank 12. The resin discharge device 26 is then moved axially along tank 12 in the direction of arrow 50 so that similar sets of beads 24 and alternating channels 40 and aligned passageways 42 may be formed in the above described manner in the remainder of the exterior side surface 28 of tank 12.

Figure 4:
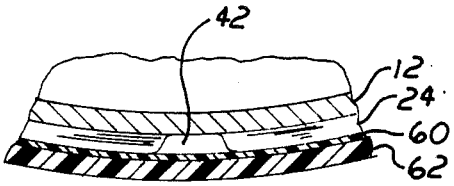
FIG. 4 is a sectional view, taken along line 4—4 of FIG. 1. and shown at an enlarged scale, of the lower portion of the completed tank of FIG. 1, showing a passageway that interconnects the channel means.

As shown in FIGS. 1 and 4, a web of substantially imperforate material, such as a stretched film 60 of synthetic resin is stretched over spacer material 22 as tank 12 is rotated on its spindles 18. This film is preferably composed of a thin flexible material such as Mylar, polyethylene or the like. Film 60 is typically applied over the beads 24 of spacer material 22 when the spacer material is in a hardened condition. When film 60 is applied, it engages beads 24 and is stretched over channels 40. A sheathing material 62 is then applied over film 60 in the manner described in U.S. Pat. No. 4,640,439, which is incorporated herein by reference. This application of stretched film 60 over beads 24 prevents subsequent material used in forming the outer sheath 62 from contacting those portions of inner tank 12 over which the beaded spacer material is applied.

Following completion of tank 10, as shown in FIG. 1, various additional steps may be performed such as forming a manhole in the tank, attaching fittings thereto and providing means for detecting the presence of fluids that have collected between the inner tank 12 and the outer sheath 62. These additional steps are likewise all shown and described in detail in U.S. Pat. Nos. 4,640,439 and 4,644,627 and co-pending application Ser. No. 043,634.

Passageways 42 enable fluid that has leaked into channels 40, either from the interior of inner tank 12 or from the exterior of the outer sheath 62 to collect in the bottom of the tank and be detected in the manner such as is shown in U.S. Pat. Nos. 4,640,439, and 4,644,627.

By the foregoing construction there is thus provided a double wall tank that can be manufactured economically from a conventional steel wall tank and even from a used tank that has previously been removed from underground storage use. This structure provides an exterior sheath, which may be formed from a material that is free of any tendency to rust or corrode, and which is spaced from the inner tank to permit the collection within that space and thus detection of any liquids leaking into that space, either from the tank or from sources exterior to the sheath. Thus may be determined the existence of any leakage of either the tank or the sheath by simply detecting the presence and nature of any liquid present in that space. By the use of a relatively thick and rigid outer sheath, the strength of that sheath is enhanced over similar structures that may use flexible outer covering. Furthermore, such a rigid external sheath permits testing of the integrity of the sheath and tank at substantial pressures, which could not be done with a flexible covering without danger of rupture. Moreover the liquid accommodating channels may be formed without the necessity of removing resin spacer material that has been applied. Resin material and labor are thereby saved and costs are reduced.

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed is:

1. A method of manufacturing from a rigid single wall inner tank for storage of liquids, a double wall tank, said method comprising the steps of:

applying to at least a portion of the exterior surface of said rigid inner tank a plurality of spaced apart, generally parallel beads of a hardenable, viscous liquid synthetic resin spacer material to form, between adjacent said beads, channel means that provide for substantially free passage of liquids through said channel means;

stretching a substantially imperforate film over said synthetic resin beads and over said channel means to separate said inner tank and said spacer material from subsequently applied sheath material; and applying over said film overlying said beads a substantially rigid outer sheath of a material that is substantially liquid-tight, said sheath being spaced from at least a portion of said inner tank exterior surface by said film and said beads, whereby is provided a rigid double wall tank.

2. The method of claim 1 wherein said step of applying a plurality of beads of resin material comprises disposing a resin dispensing apparatus having a plurality of discharge ports adjacent said inner tank, discharging said resin substantially simultaneously through said discharge ports and moving said inner tank and said resin dispensing apparatus relative to one another to dispense said beads of resin on the exterior of said inner tank.

3. The method of claim 1 wherein said synthetic resin spacer material includes a self-expanding foaming agent.

4. The method of claim 1 wherein said channel means include at least one pair of adjacent channels separated by a respective said bead and wherein said method further includes the step of forming passageway means for interconnecting said adjacent channels.

5. The method of claim 4 wherein said passageway means are formed by scoring said beads between said adjacent channels.

6. The method of claim 4 wherein said passageway means are formed by interrupting the discharge of said resin through said discharge ports while continuing to move said inner tank and said resin dispensing apparatus relative to one another.

7. The method of claim 1 wherein said inner tank has the configuration generally of a cylinder with a cylindrical axis and closed ends and wherein said spacer material is applied to the cylindrical wall portions thereof, whereby said spacer material will serve to space the outer sheath radially from the outer surface of the cylindrical wall of the inner tank, with the sheath being of a generally cylindrical form with cylindrical wall portions and closed end portions and said step of applying a plurality of beads of resin material comprises disposing a resin dispensing apparatus having a plurality of discharge ports adjacent said inner tank, discharging said resin substantially simultaneously through said discharge ports and moving said inner tank and said resin dispensing apparatus relative to one another to dispense said beads of resin on the exterior of said inner tank.

8. The method of claim 7 wherein said beads of synthetic resin spacer material are applied to said inner tank in a plurality of circumferential rows to form channel means between adjacent said rows of said synthetic resin spacer material beads, said channel means extending substantially circumferentially about said inner tank.

9. The method of claim 1 wherein said synthetic resin spacer material comprises a thermoplastic substance that hardens by cooling.

10. The method of claim 1 wherein said synthetic resin spacer material comprises a substance that hardens by catalyzing.

* * * * *